US012433326B2

(12) United States Patent
Lee et al.

(10) Patent No.: US 12,433,326 B2
(45) Date of Patent: Oct. 7, 2025

(54) AEROSOL GENERATING ARTICLE AND AEROSOL GENERATING SYSTEM INCLUDING THE SAME

(71) Applicant: KT&G CORPORATION, Daejeon (KR)

(72) Inventors: Tae Kyung Lee, Daejeon (KR); Chan Min Kwon, Daejeon (KR); Sun Hwan Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 62 days.

(21) Appl. No.: 17/763,059

(22) PCT Filed: Oct. 18, 2021

(86) PCT No.: PCT/KR2021/014477
§ 371 (c)(1),
(2) Date: Apr. 28, 2022

(87) PCT Pub. No.: WO2022/086087
PCT Pub. Date: Apr. 28, 2022

(65) Prior Publication Data

US 2024/0108059 A1 Apr. 4, 2024

(30) Foreign Application Priority Data

Oct. 19, 2020 (KR) ..... 10-2020-0135518

(51) Int. Cl.
*A24D 1/20* (2020.01)
*A24D 3/04* (2006.01)
(Continued)

(52) U.S. Cl.
CPC ..... *A24D 1/20* (2020.01); *A24D 3/04* (2013.01); *A24D 3/061* (2013.01); *A24F 40/10* (2020.01); *A24F 40/46* (2020.01); *A24F 40/50* (2020.01)

(58) Field of Classification Search
None
See application file for complete search history.

(56) References Cited

U.S. PATENT DOCUMENTS 8,960,199 B2 2/2015 Zhuang et al.
11,140,916 B2 10/2021 Zuber et al.
(Continued)

FOREIGN PATENT DOCUMENTS

CN 111387543 A 7/2020
JP 2019-180323 A 10/2019
(Continued)

OTHER PUBLICATIONS

KR-2020068449-A, Aerosol generating article and aerosol generating apparatus used therewith, Jun. 15, 2020 (Year: 2020).*
(Continued)

*Primary Examiner* — Manley L Cummins, IV
(74) *Attorney, Agent, or Firm* — Sughrue Mion, PLLC

(57) ABSTRACT

An aerosol generating article includes: a first segment impregnated with a first liquid composition; a second segment impregnated with a second liquid composition that is different from the first liquid composition; a cooler configured to cool aerosol by allowing the aerosol, generated from the first segment or the second segment, to pass through the cooler; and a filter configured to filter the aerosol by allowing the aerosol having passed through the cooler to pass through the filter, wherein at least a portion of the filter is recessed to thereby form a cavity in the filter.

11 Claims, 11 Drawing Sheets

(51) Int. Cl.

| | |
|---|---|
| ***A24D 3/06*** | (2006.01) |
| ***A24F 40/10*** | (2020.01) |
| ***A24F 40/46*** | (2020.01) |
| ***A24F 40/50*** | (2020.01) |

(56) References Cited

U.S. PATENT DOCUMENTS

| | | | |
|---|---|---|---|
| 11,246,998 | B2 | 2/2022 | Greim et al. |
| 2020/0113227 | A1 | 4/2020 | Mclaughlin et al. |
| 2020/0352220 | A1 | 11/2020 | Cheong et al. |
| 2020/0397035 | A1 | 12/2020 | Lee et al. |
| 2021/0000175 | A1 | 1/2021 | Hwang et al. |
| 2021/0267266 | A1 | 9/2021 | Park et al. |

FOREIGN PATENT DOCUMENTS

| | | | | |
|---|---|---|---|---|
| KR | 10-2007-0107159 | A | 11/2007 | |
| KR | 10-2014-0009385 | A | 1/2014 | |
| KR | 10-2014-0130137 | A | 11/2014 | |
| KR | 10-2015-0129683 | A | 11/2015 | |
| KR | 10-2020-0031079 | A | 3/2020 | |
| KR | 10-2020-0068449 | A | 6/2020 | |
| WO | WO-2008017960 | A2 * | 2/2008 | ..... A24D 3/0283 |
| WO | 2012/123702 | A1 | 9/2012 | |
| WO | WO-2019110747 | A1 * | 6/2019 | ..... A24B 15/14 |
| WO | 2019/224366 | A1 | 11/2019 | |
| WO | 2020/105942 | A1 | 5/2020 | |
| WO | WO-2020091394 | A1 * | 5/2020 | ..... A24B 15/12 |
| WO | WO-2020105940 | A1 * | 5/2020 | ..... A24D 1/045 |
| WO | WO-2020256341 | A1 * | 12/2020 | ..... A24D 1/20 |

OTHER PUBLICATIONS

Supplementary European Search Report issued Nov. 25, 2022 in European Application No. 21867908.2.

Notice of Reasons for Refusal issued Apr. 18, 2023 in Japanese Application No. 2022-516749.

International Search Report of PCT/KR2021/014477 dated Jan. 24, 2022 [PCT/ISA/210].

* cited by examiner

AEROSOL GENERATING ARTICLE AND AEROSOL GENERATING SYSTEM INCLUDING THE SAME

CROSS REFERENCE TO RELATED APPLICATIONS

This application is a National Stage of International Application No. PCT/KR2021/014477, filed Oct. 18, 2021, claiming priority to Korean Patent Application No. 10-2020-0135518, filed Oct. 19, 2020.

TECHNICAL FIELD

One or more embodiments relate to an aerosol generating article and an aerosol generating system including the same, and more particularly, to an aerosol generating article impregnated with different liquid compositions and an aerosol generating system including the aerosol generating article.

BACKGROUND ART

Recently, the demand for alternative methods to overcome the disadvantages of traditional cigarettes has increased. For example, there is growing demand for an aerosol generating device which generates aerosol by heating an aerosol generating material in cigarettes, rather than by combusting cigarettes. Accordingly, researches on a heating-type cigarette or a heating-type aerosol generating device have been actively conducted.

In addition, demand for an aerosol generating device for generating aerosol by heating a liquid-type aerosol generating material has increased. This type aerosol generating device stores a liquid composition, and when a user is to inhale aerosol, the aerosol generating device vaporizes the stored liquid composition to generate aerosol.

In the case of the aerosol generating device in which the liquid composition is stored, there may be an inconvenience that, when the liquid composition is exhausted, the liquid composition may have to be additionally injected into the aerosol generating device, or a new device may have to be purchased. Accordingly, research is required into an easily re-usable aerosol generating article that generates aerosol by using liquid compositions for providing various flavors to a user.

DESCRIPTION OF EMBODIMENTS

Technical Problem

One or more embodiments provide an aerosol generating article impregnated with a liquid composition and an aerosol generating system including the aerosol generating article.

Problems to be solved by the one or more embodiments are not limited to those described above, and other objectives that are not described may be clearly understood by one of ordinary skill in the art from this specification and the accompanying drawings.

Solution to Problem

According to one or more embodiments, an aerosol generating article includes: a first segment impregnated with a first liquid composition; a second segment impregnated with a second liquid composition that is different from the first liquid composition; a cooler configured to cool aerosol by allowing the aerosol, generated from the first segment or the second segment, to pass through the cooler; and a filter configured to filter the aerosol by allowing the aerosol having passed through the cooler to pass through the filter, wherein at least a portion of the filter is recessed to thereby form a cavity in the filter.

An aerosol generating system includes: the aerosol generating article according to the one or more embodiments; and an aerosol generating device including an accommodation space configured to accommodate the aerosol generating article and a heating element configured to heat the aerosol generating article.

Advantageous Effects of Disclosure

An aerosol generating article according to one or more embodiments may be impregnated with different liquid compositions, and thus, may provide a user with aerosol having various flavors.

Moreover, in a filter of an aerosol generating article according to one or more embodiments, a cavity through which aerosol may flow may be formed, and thus, the aerosol generating article may have an absorption resistance for providing a satisfactory smoking impression to a user.

In addition, a user may detachably arrange an aerosol generating article in an aerosol generating device, and after using the aerosol generating article, may remove the aerosol generating article, and thus, may simply prepare a next aerosol absorption.

The effects according to one or more embodiments are not limited to those described above, and other advantages that are not described may be clearly understood by one of ordinary skill in the art from this specification and the accompanying drawings.

BEST MODE

Figure 1:
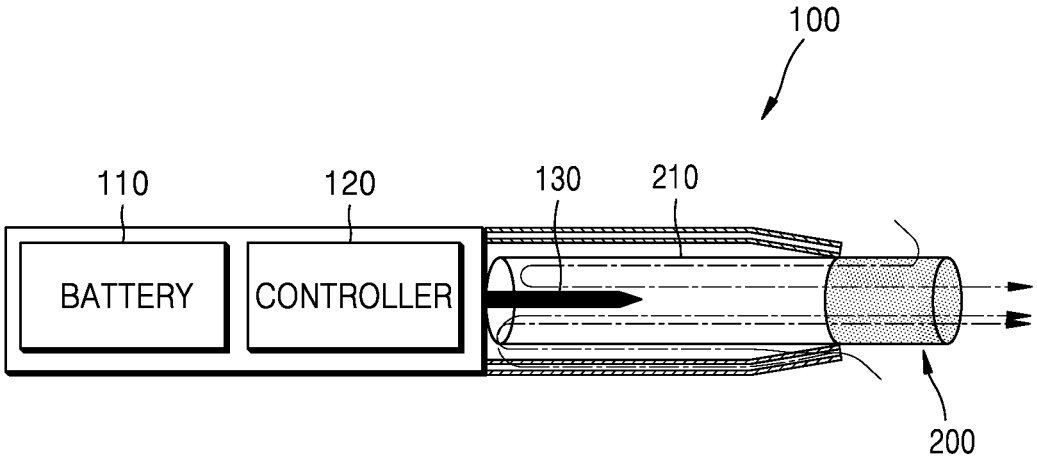
FIG. 1 is a diagram showing an example in which a cigarette is inserted into an aerosol generating device.

According to one or more embodiments, an aerosol generating article includes: a first segment impregnated with a first liquid composition; a second segment impregnated with a second liquid composition that is different from the first liquid composition; a cooler configured to cool aerosol by allowing the aerosol, generated from the first segment or the second segment, to pass through the cooler; and a filter configured to filter the aerosol by allowing the aerosol having passed through the cooler to pass through the filter, wherein at least a portion of the filter is recessed to thereby form a cavity in the filter.

Each of the first liquid composition and the second liquid composition may include a tobacco extract.

The tobacco extract of the first liquid composition may be nicotine salts, and the tobacco extract of the second liquid composition may be freebase nicotine.

An amount of the first liquid composition impregnated in the first segment may be less than an amount of the second liquid composition impregnated in the second segment.

A wound sheet may be filled in each of the first segment and the second segment.

A filling density of the sheet filled in the first segment may be different from a filling density of the sheet filled in the second segment.

The filter may include a flavor material adding a flavor to the aerosol having passed through the cooler.

The filter may include: a first filter portion connected to the cooler and including cellulose acetate; and a second filter portion connected to the first filter portion, and at least a portion of the second filter portion is recessed in a direction toward the cooler to thereby form the cavity in the second filter portion.

The cavity may extend in a longitudinal direction of the aerosol generating article, and a cross-sectional area of the cavity may increase as the cavity extends in the longitudinal direction of the aerosol generating article.

The second filter portion may include a projector projecting from an inner surface of the second filter portion toward the cavity and changing circulation of the aerosol in the cavity.

According to one or more embodiments, an aerosol generating system includes: the aerosol generating article according to the one or more embodiments; and an aerosol generating device including an accommodation space configured to accommodate the aerosol generating article and a heating element configured to heat the aerosol generating article.

The heating element may be configured to surround the first segment and the second segment when the aerosol generating article is inserted into the aerosol generating device.

A length of the heating element may be less than a sum of a length of the first segment and a length of the second segment.

Mode of Disclosure

With respect to the terms used to describe in the various embodiments, the general terms which are currently and widely used are selected. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

The terms used in this specification are for describing embodiments and do not limit the embodiments. In this specification, a singular form also includes a plural form unless particularly otherwise mentioned.

The terms including ordinal numbers such as "first," "second," etc., used in this specification, may be used to describe various components, but the components shall not be limited by these terms. These terms may be used for distinguishing one component from another component.

Throughout the specification, a "longitudinal direction" of a component may be an axis direction in which the component extends, wherein the axis direction may indicate one of two axis directions, in which the component extends longer in one axis direction than in the other axis direction.

Throughout the specification, an "embodiment" is an arbitrary concept for conveniently describing the disclosure in the specification, and embodiments shall not be exclusive with respect to each other. For example, configurations disclosed in an embodiment may be applied and realized in other embodiments. Here, changes made to the configurations applied and realized in the other embodiments should be within an extent not deviating from the scope of the specification.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a diagram showing an example in which a cigarette is inserted into an aerosol generating device.

Referring to FIG. 1, the aerosol generating device 100 may include a battery 110, a controller 120, and a heating element 130. Also, the cigarette 200 may be inserted into an inner space of the aerosol generating device 100.

FIG. 1 illustrates components of the aerosol generating device 100, which are related to the present embodiment. Therefore, it will be understood by one of ordinary skill in the art related to the present embodiment that other general-purpose components may be further included in the aerosol generating device 100, in addition to the components illustrated in FIG. 1.

FIG. 1 illustrates that the battery 110, the controller 120, and the heating element 130 are arranged in series, but the arrangement of these are not limited thereto. In other words, according to the design of the aerosol generating device 100, the battery 110, the controller 120, and the heating element 130 may be differently arranged.

When the cigarette 200 is inserted into the aerosol generating device 100, the aerosol generating device 100 heats the heating element 130. The temperature of an aerosol generating material in the cigarette 200 is raised by the heated heating element 130, and thus the aerosol is generated. The generated aerosol is delivered to a user through a filter 220 of the cigarette 200.

As necessary, even when the cigarette 200 is not inserted into the aerosol generating device 100, the aerosol generating device 100 may heat the heating element 130.

The battery 110 may supply power to be used for the aerosol generating device 100 to operate. For example, the battery 110 may supply power to heat the heating element 130, and may supply power for operating the controller 120. Also, the battery 110 may supply power for operations of a display, a sensor, a motor, etc. mounted in the aerosol generating device 100.

The controller 120 may generally control operations of the aerosol generating device 100. In detail, the controller 120 may control not only operations of the battery 110 and the heating element 130, but also operations of other components included in the aerosol generating device 100. Also, the controller 120 may check a state of each of the components of the aerosol generating device 100 to determine whether or not the aerosol generating device 100 is able to operate.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heating element 130 may be heated by power supplied from the battery 110. For example, when the cigarette is inserted into the aerosol generating device 100, the heating element 130 may be located inside the cigarette. Thus, the heated heating element 130 may increase a temperature of an aerosol generating material in the cigarette.

The heating element 130 may include an electro-resistive heater. For example, the heating element 130 may include an electrically conductive track, and the heating element 130 may be heated when currents flow through the electrically conductive track. However, the heating element 130 is not limited to the example described above and may include all heaters which may be heated to a desired temperature. Here, the desired temperature may be pre-set in the aerosol generating device 100 or may be set by a user.

As another example, the heating element 130 may include an induction heater. In detail, the heating element 130 may include an electrically conductive coil for heating a cigarette in an induction heating method, and the cigarette may include a susceptor which may be heated by the induction heater.

FIG. 1 illustrates that the heating element 130 is inserted into the cigarette 200, but it is not limited thereto. For example, the heating element 130 may include a tube-type heating element, a plate-type heating element, a needle-type heating element, or a rod-type heating element, and may heat the inside or the outside of the cigarette 200, according to the shape of the heating element.

Also, the aerosol generating device 100 may include a plurality of heating elements 130. Here, the plurality of heating elements 130 may be inserted into the cigarette 200 or may be arranged outside the cigarette 200. Also, some of the plurality of heating elements 130 may be inserted into the cigarette 200, and the others may be arranged outside the cigarette 200. In addition, the shape of the heating element 130 is not limited to the shape illustrated in FIG. 1, and may include various shapes.

The aerosol generating device 100 may further include general-purpose components in addition to the battery 110, the controller 120, and the heating element 130. For example, the aerosol generating device 100 may include a display capable of outputting visual information and/or a motor for outputting haptic information. Also, the aerosol generating device 100 may include at least one sensor (a puff detecting sensor, a temperature detecting sensor, an cigarette insertion detecting sensor, etc.).

Also, the aerosol generating device 100 may be formed as a structure that, even when the cigarette 200 is inserted into the aerosol generating device 100, may introduce external air or discharge internal air.

Although not illustrated in FIG. 1, the aerosol generating device 100 and an additional cradle may form together a system. For example, the cradle may be used to charge the battery 110 of the aerosol generating device 100. Alternatively, the heating element 130 may be heated when the cradle and the aerosol generating device 100 are coupled to each other.

The cigarette 200 may be similar to a general combustive cigarette. For example, the cigarette 200 may be divided into a first portion 210 including an aerosol generating material and a second portion 220 including a filter or the like. Alternatively, the second portion 220 of the cigarette 200 may also include an aerosol generating material. For example, an aerosol generating material made in the form of granules or capsules may be inserted into the second portion 220.

The first portion 210 may be completely inserted into the aerosol generating device 100, and the second portion 220 may be exposed to the outside. Alternatively, only a portion of the first portion 210 may be inserted into the aerosol generating device 100, or a portion of the first portion 210 and a portion of the second portion 220 may be inserted thereinto. The user may puff aerosol while holding the second portion 220 by the mouth of the user. In this case, the aerosol is generated by the external air passing through the first portion 210, and the generated aerosol passes through the second portion 220 and is delivered to the user's mouth.

For example, the external air may flow into at least one air passage formed in the aerosol generating device 100. For example, opening and closing of the air passage and/or a size of the air passage formed in the aerosol generating device 100 may be adjusted by the user. Accordingly, the amount and the quality of smoking may be adjusted by the user. As another example, the external air may flow into the cigarette 200 through at least one hole formed in a surface of the cigarette 200.

Hereinafter, an example of the cigarette 200 will be described with reference to FIG. 2.

Figure 2:
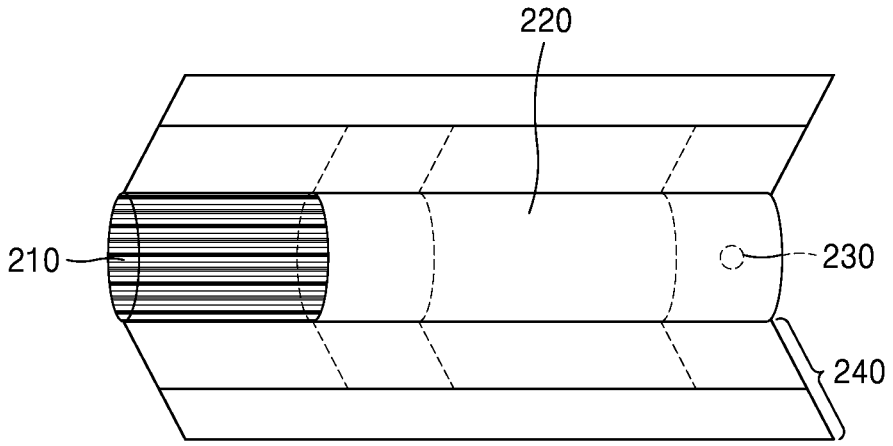
FIG. 2 shows a view showing an example of the cigarette.

FIG. 2 shows a view showing an example of the cigarette.

Referring to FIG. 2, the cigarette 200 includes a tobacco rod 210 and a filter rod 220. The first portion described above with reference to FIG. 1 includes the tobacco rod 210, and the second portion includes the filter rod 220.

FIG. 2 illustrates that the filter rod 220 includes a single segment, but is not limited thereto. In other words, the filter rod 220 may include a plurality of segments. For example, the filter rod 220 may include a first segment configured to cool an aerosol and a second segment configured to filter a certain component included in the aerosol. Also, as necessary, the filter rod 220 may further include at least one segment configured to perform other functions.

The cigarette 200 may be packaged by at least one wrapper 240. The wrapper 240 may have at least one hole through which external air may be introduced or internal air may be discharged. For example, the cigarette 200 may be packaged by one wrapper 240. As another example, the cigarette 200 may be doubly packaged by two or more wrappers 240. For example, the tobacco rod 210 may be packaged by a first wrapper, and the filter rod 220 may be packaged by a second wrapper. Also, the tobacco rod 210 and the filter rod 220, which are respectively packaged by separate wrappers, may be coupled to each other, and the entire cigarette 200 may be packaged by a third wrapper. When each of the tobacco rod 210 or the filter rod 220 is composed of a plurality of segments, each segment may be packaged by separate wrappers. Also, the entire cigarette 200 including the plurality of segments, which are respectively packaged by the separate wrappers and which are coupled to each other, may be re-packaged by another wrapper.

The tobacco rod 210 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 210 may be manufactured in various forms. For example, the tobacco rod 210 may be formed as a sheet or a strand. Also, the tobacco rod 210 may be formed as a pipe tobacco, which is formed of tiny bits cut from a tobacco sheet. Also, the tobacco rod 210 may be surrounded by a heat conductive material. For example, the heat conductive material may be, but is not limited to, a metal foil such as aluminum foil. For example, the heat conductive material surrounding the tobacco rod 210 may uniformly distribute heat transmitted to the tobacco rod 210, and thus, the heat conductivity applied to the tobacco rod may be increased and taste of the tobacco may be improved. Also, the heat conductive material surrounding the tobacco rod 210 may function as a susceptor heated by the induction heater. Here, although not illustrated in the drawings, the tobacco rod 210 may further include an additional susceptor, in addition to the heat conductive material surrounding the tobacco rod 210.

The filter rod 220 may include a cellulose acetate filter. Shapes of the filter rod 220 are not limited. For example, the filter rod 220 may include a cylinder-type rod or a tube-type rod having a hollow inside. Also, the filter rod 220 may include a recess-type rod. When the filter rod 220 includes a plurality of segments, at least one of the plurality of segments may have a different shape.

The filter rod 220 may be formed to generate flavors. For example, a flavoring liquid may be injected onto the filter rod 220, or an additional fiber coated with a flavoring liquid may be inserted into the filter rod 220.

Also, the filter rod 220 may include at least one capsule 230. Here, the capsule 230 may perform a function of generating a flavor or an aerosol. For example, the capsule 230 may have a configuration in which a liquid containing a flavoring material is wrapped with a film. For example, the capsule 230 may have a spherical or cylindrical shape, but is not limited thereto.

When the filter rod 220 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Figure 3:
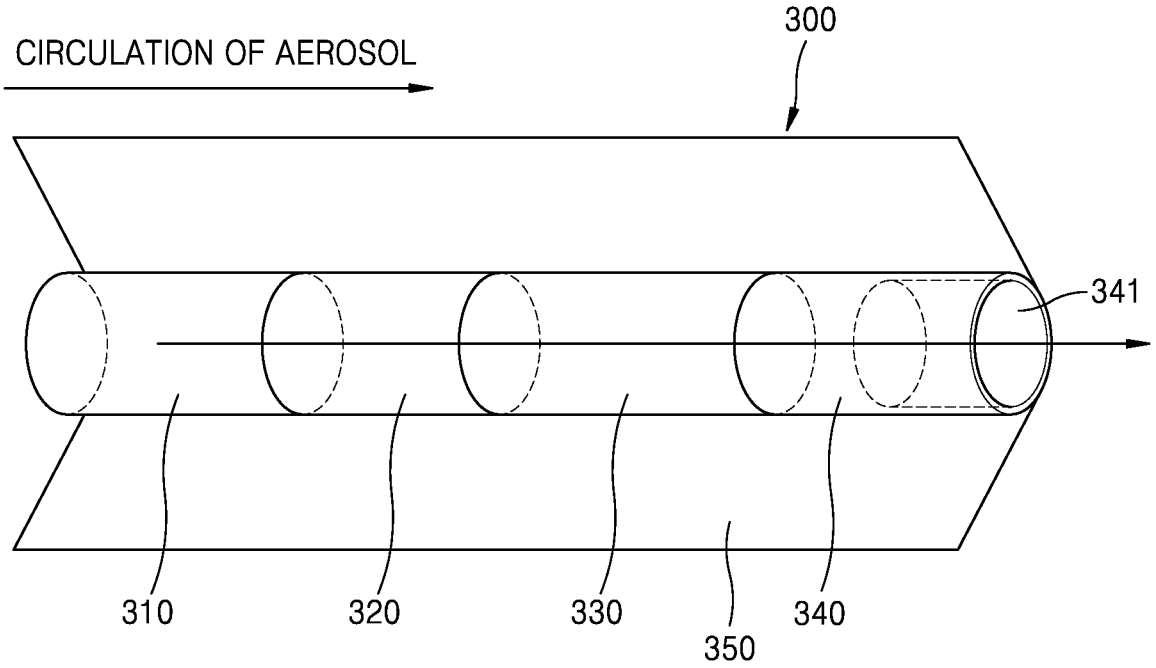
FIG. 3 is a view of an aerosol generating article according to an embodiment.

FIG. 3 is a view of an aerosol generating article 300 according to an embodiment.

Referring to FIG. 3, the aerosol generating article according to an embodiment may include a first segment 310, a second segment 320, a cooler 330, a filter 340, and a wrapper 350.

The first segment 310 may be impregnated with a first liquid composition. When the first liquid composition of the first segment 310 is heated, aerosol may be generated.

The first liquid composition may include a tobacco extract. The tobacco extract may be pure nicotine naturally generated or synthetic nicotine. The tobacco extract may have a concentration of a predetermined appropriate weight to the total solution weight of the first liquid composition. For example, the tobacco extract may include freebase nicotine or nicotine salt, but is not limited thereto.

The first liquid composition may include two or more types of nicotine salt. Nicotine salt may be formed by adding suitable acids, including organic or inorganic acids, to nicotine. Acid for the formation of the nicotine salts may be appropriately selected considering the rate of nicotine absorption in the blood, a temperature at which the aerosol generating article 300 is heated, the flavor or savor, the solubility, or the like.

For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, and malonic acid or malic acid, or a mixture of two or more acids selected from the group, but is not limited thereto.

Moreover, the first liquid composition may include a moisturizer. The moisturizer may serve as an aerosol formation agent that is heated to provide a sufficient amount of smoke. For example, the moisturizer may include glycerin, propylene glycol, or a mixture thereof, but is not limited thereto.

In addition, the first liquid composition may include, for example, any one component of water, solvents, ethanol, plant extracts, spices, and flavorings, or a mixture of these components. The spices may include menthol, peppermint or spear mint oil, various fruit aroma components, etc., but are not limited thereto. The flavorings may include a component providing various spices or flavors to a user.

The second segment 320 may be impregnated with a second liquid composition that is different from the first liquid composition. When the second liquid composition of the second segment 320 is heated, aerosol may be generated. In addition, the second segment 320 may be arranged at a side of the first segment 310 and may allow aerosol generated by the first segment 310 to pass therethrough.

The second liquid composition may include substantially the same component as the first liquid composition, but may be different from the first liquid composition in terms of a type of the included tobacco extract.

For example, the tobacco extract included in the first liquid composition may be nicotine salt, and the tobacco extract included in the second liquid composition may be freebase nicotine. In this case, freebase nicotine has a lower thermal stability than nicotine salt and thus is easily vaporized. Therefore, when the aerosol generating article 300 is heated, an exhaustion speed of the first liquid composition may be higher than an exhaustion speed of the second liquid composition. Accordingly, to provide aerosol having a constant flavor to a user, the amount of first liquid composition impregnated in the first segment 310 may be less than the amount of second liquid composition impregnated in the second segment 320.

Spices included in the first liquid composition or spices included in the second liquid composition may cooperate to provide a mixed flavor to a user. For example, each of aerosol generated from the spices included in the first liquid composition and aerosol generated from the spices included in the second liquid composition may be mixed to provide a new flavor to the user or reinforce any one flavor.

As described above, in the aerosol generating article 300 according to an embodiment, the liquid compositions that are different from each other may be impregnated in the first segment 310 and the second segment 320, and thus, aerosol generated by the first segment 310 and aerosol generated by the second segment 320 may cooperate to provide various flavors to the user.

The cooler 330 may cool the aerosol generated by the first segment 310 or the second segment 320 by allowing the aerosol to pass therethrough. The cooler 330 may be arranged at a side of the second segment 320 and may be connected to the second segment 320.

The cooler 330 may include, for example, polylactic acid or cellulose acetate, as a material thereof. However, the material of the cooler 330 is not limited thereto and may include any material that may cool aerosol. For example, the cooler 330 may include a tube filter or a ground pipe including a cavity.

The filter 340 may be arranged at a side of the cooler 330 and may filter the aerosol having passed through the cooler 330 by allowing the aerosol to pass therethrough. Moreover, the filter 340 may cool the aerosol having passed through the cooler 330 by allowing the aerosol to pass therethrough. For example, the filter 340 may include cellulose acetate, as a material thereof, but is not limited thereto.

The filter 340 may include a cavity 341. The cavity 341 may be formed, as at least a portion of the filter 340 is recessed. For example, the cavity 341 may be formed, as an end of the filter 340 is recessed in a direction toward the cooler 330. Here, the end of the filter 340 denotes an end of the filter 340 at a side opposite to a side of the filter 340, the side being connected to the cooler 330.

A side of the cavity 341 may be open to the outside of the aerosol generating article 300. The aerosol having passed through the cooler 330 may circulate in the cavity 341, and then, may be discharged to the outside of the aerosol generating article 300 via absorption by the user. Therefore, the aerosol generating article 300 may provide a soft absorption impression to the user.

With respect to an aerosol generating article including a solid-type aerosol generating material, a filtering capacity of a filter may become important to filter particles that may be generated by heating the solid-type aerosol generating material. In contrast, with respect to an aerosol generating article impregnated with a liquid composition, the necessity of the filtering capacity of the filter may be relatively decreased.

Therefore, the aerosol generating article 300 according to an embodiment may include the filter 340 including the cavity 341 through which aerosol may be circulated, the cavity being formed as at least a portion of the filter 340 is recessed. Therefore, the absorption resistance of the filter 340 may be reduced, and a soft absorption impression may be provided to the user.

The wrapper 350 may form an external surface of the aerosol generating article 300 by surrounding the aerosol generating article 300. For example, FIG. 3 illustrates that the aerosol generating article 300 includes one wrapper 350. However, the aerosol generating article 300 is not limited thereto, and a plurality of wrappers 350 may surround the first segment 310, the second segment 320, the cooler 330, and the filter 340, respectively.

Figure 4:
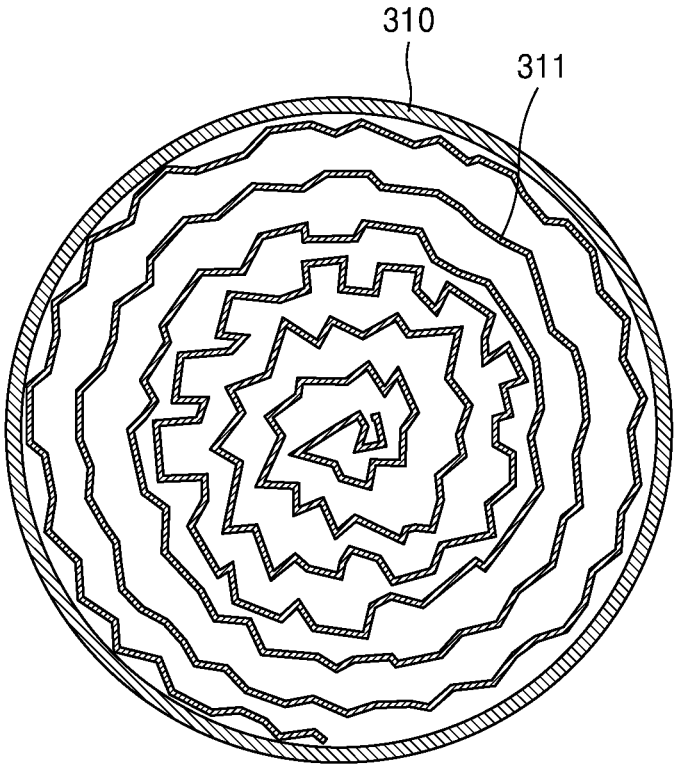
FIG. 4 is a cross-sectional view of a first segment of the aerosol generating article of FIG. 3.
Figure 5:
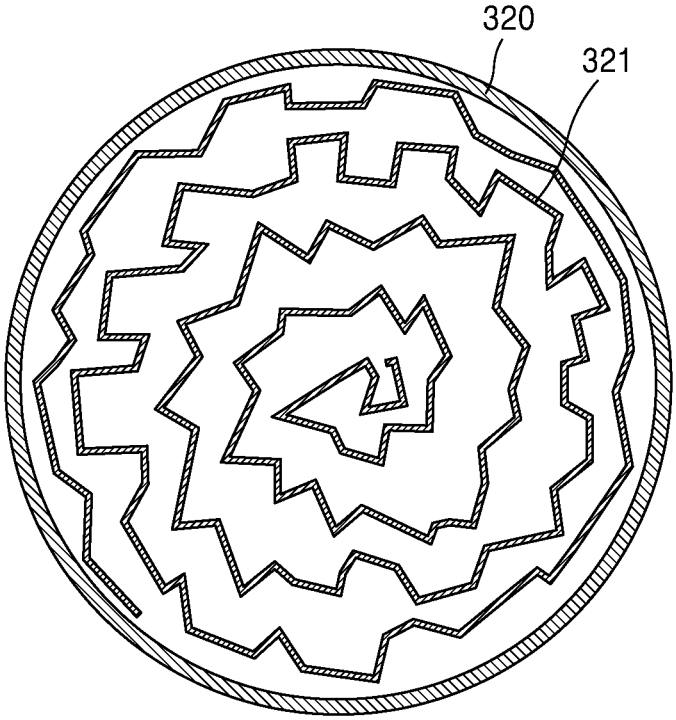
FIG. 5 is a cross-sectional view of a second segment of the aerosol generating article of FIG. 3.

FIG. 4 is a cross-sectional view of the first segment 310 of the aerosol generating article 300 illustrated in FIG. 3, and FIG. 5 is a cross-sectional view of the second segment 320 of the aerosol generating article 300 illustrated in FIG. 3.

Referring to FIG. 4, a wound sheet 311 may be filled in the first segment 310. The sheet 311 may include a polymer material or a cellulose material, which may absorb an aerosol generating material. For example, the sheet 311 may be a paper sheet from which smell is not generated by heat even when the sheet is heated to a high temperature, but is not limited thereto.

The sheet 311 may have a wound shape. Here, the wound shape may denote a shape in which the sheet 311 is processed to be wrinkled and includes at least one curve. The process of winding the sheet 311 may include at least one of a crimping process, a pleating process, and a gathering process, but is not limited thereto.

The first liquid composition may be impregnated in the sheet 311, and thus, the first segment 310 may contain the first liquid composition. For example, the first liquid composition may be adsorbed by a surface of the sheet 311 or may be absorbed into the sheet 311 so that the first segment 310 may be impregnated with the first liquid composition.

Referring to FIG. 5, a wound sheet 321 may be filled in the second segment 320. The second segment 320 may be filled with the wound sheet 321 in substantially the same shape as the first segment 310. However, the second segment 320 may have a different filling density from the first segment 310.

The filling density may denote a volume or a mass occupied by the sheet 311 or 321 in a space defined by the first segment 310 or the second segment 320. That is, as the filling density increases, it may denote that the amount of filled sheet 311 or 312 in the first segment 310 or the second segment 320 increases.

The filling density of the sheet 311 filled in the first segment 310 may be different from the filling density of the sheet 321 filled in the second segment 320. For example, the filling density of the sheet 311 filled in the first segment 310 may be higher than the filling density of the sheet 321 filled in the second segment 320. Accordingly, an absorption resistance of the first segment 310 may be higher than an absorption resistance of the second segment 320, and the leakage of the first liquid composition impregnated in the first segment 310 to the outside of the aerosol generating article may be prevented.

FIGS. 4 and 5 illustrate that the first segment 310 and the second segment 320 have a shape in which one wound sheet is rolled. However, the first segment 310 or the second segment 320 is not limited thereto, and the first segment 310 or the second segment 320 may have a shape in which a plurality of wound sheets are filled.

Figure 6A:
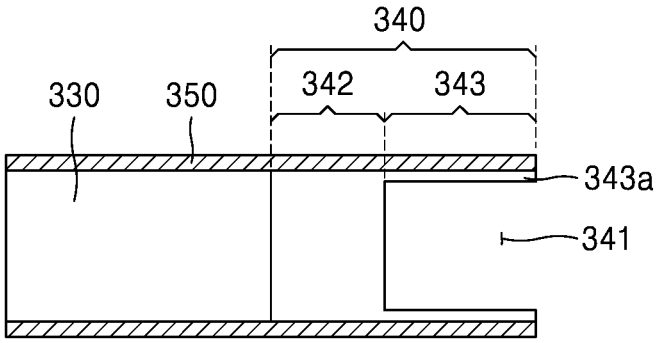
FIG. 6A is a view of a cooler and a filter of the aerosol generating article of FIG. 3.
Figure 6B:
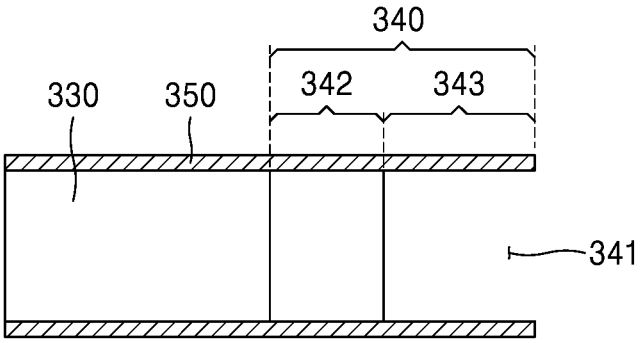
FIG. 6B is a view of a cooler and a filter of an aerosol generating article according to another embodiment.

FIG. 6A is a view of the cooler 330 and the filter 340 of the aerosol generating article illustrated in FIG. 3, and FIG. 6B is a view of the cooler 330 and the filter 340 of an aerosol generating article according to another embodiment. With reference to FIGS. 6A and 6B, an arrangement relationship between components of the filter 340 of the aerosol generating article may be identified in more detail.

Referring to FIG. 6A, the filter 340 of the aerosol generating article may include a first filter portion 342 and a second filter portion 343. The first filter portion 342 may be connected to the cooler 330. The first filter portion 342 may allow aerosol having passed through the cooler 330 to pass therethrough, thereby filtering the aerosol. For example, the first filter portion 342 may include cellulose acetate, as a material thereof.

The second filter portion 343 may include the cavity 341 and may be connected to the first filter portion 342. An area of the second filter portion 343, except for an area in which the cavity 341 is formed, may include a filtering material 343*a* for filtering the aerosol having passed through the cooler 330. For example, the filtering material 343*a* may include cellulose acetate.

At least a portion of the filtering material 343*a* included in the second filter portion 343 may be recessed in a direction toward the cooler 330 to form the cavity 341. In other words, the filtering material 343*a* may define the cavity 341, and an external surface of the filtering material 343*a* may be surrounded by the wrapper 350.

Referring to FIG. 6B, the filter 340 of the aerosol generating article according to another embodiment may include the first filter portion 342 and the second filter portion 343. The cavity 341 of the second filter portion 343 of the aerosol generating article according to another embodiment may be defined by the wrapper 350. In other words, in the aerosol generating article according to another embodiment, the second filter portion 343 may not include the filtering material 343*a*, and thus, the cavity 341 may be arranged to directly contact the wrapper 350.

As described above, the cavity 341 of the filter 340 may be formed as at least a portion of the filtering material 343*a* included in the second filter portion 343 is recessed or as the wrapper 350 defines the cavity 341. Thus, because the aerosol generating article includes the cavity 341, the absorption resistance of the filter 340 may be decreased, and thus, a soft absorption impression may be provided to a user.

Figure 7:
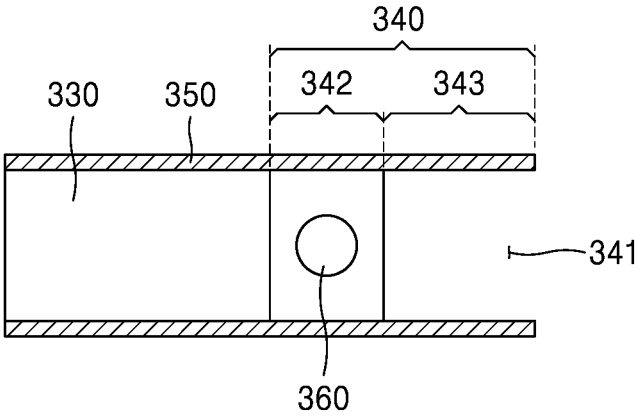
FIG. 7 is a view of a cooler and a filter of an aerosol generating article according to another embodiment.

FIG. 7 illustrates the cooler 330 and the filter 340 of an aerosol generating article according to another embodiment.

Referring to FIG. 7, the filter 340 may include a flavor material 360. The flavor material 360 may add a flavor to aerosol generated by the first segment 310 or the second segment 320.

The flavor material 360 may be accommodated in the first filter portion 342. For example, the flavor material 360 may be accommodated in the first filter portion 342 by being disposed in a capsule including a film for accommodating a liquid. In this case, a user may press the flavor material 360 disposed in the capsule to impregnate the flavor material 360 in the first filter portion 342, and the flavor material 360 impregnated in the first filter portion 342 may provide various flavors to the user by being mixed with the aerosol generated by the first segment 310 or the second segment 320.

As described above, the aerosol generating article according to another embodiment may include the cavity 341, and thus, may provide a soft absorption impression to the user, and may include the flavor material 360 for adding a flavor to the aerosol generated by the first segment 310 or the second segment 320, and thus, may provide aerosol having various flavors to the user.

FIG. 7 illustrates that the flavor material 360 is accommodated in the filter 340 as a capsule type. However, it is not limited thereto, and the flavor material 360 may be injected to the filter 340 as a liquid type, or an additional fiber coated with the flavor material 360 may be inserted into the filter 340.

Figure 8:
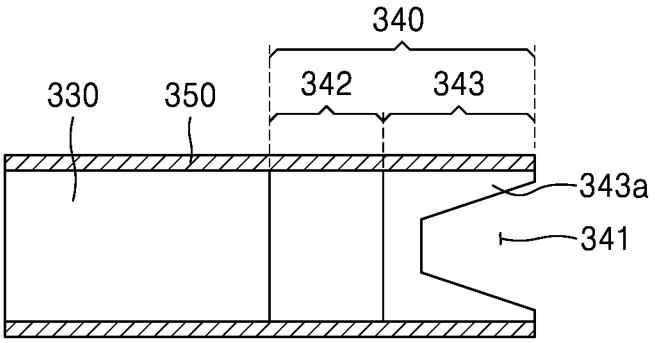
FIG. 8 is a view of a cooler and a filter of an aerosol generating article according to another embodiment.

FIG. 8 is a view of a cooler and a filter of an aerosol generating article according to another embodiment.

Referring to FIG. 8, the aerosol generating article according to another embodiment may include the cooler 330, the filter 340, and the wrapper 350. The aerosol generating article according to another embodiment may be the aerosol generating article of FIG. 6A, in which a structure of the cavity 341 is changed, and hereinafter, the same descriptions are omitted.

The cavity 341 may extend in a longitudinal direction of the aerosol generating article. A cross-sectional area of the cavity 341 may increase as the cavity 341 extends in the longitudinal direction of the aerosol generating article. Therefore, the cross-sectional area of the cavity 341 may increase toward the outside of the aerosol generating article, and thus, the aerosol generating article according to another embodiment may provide a soft absorption impression to a user.

Figure 9:
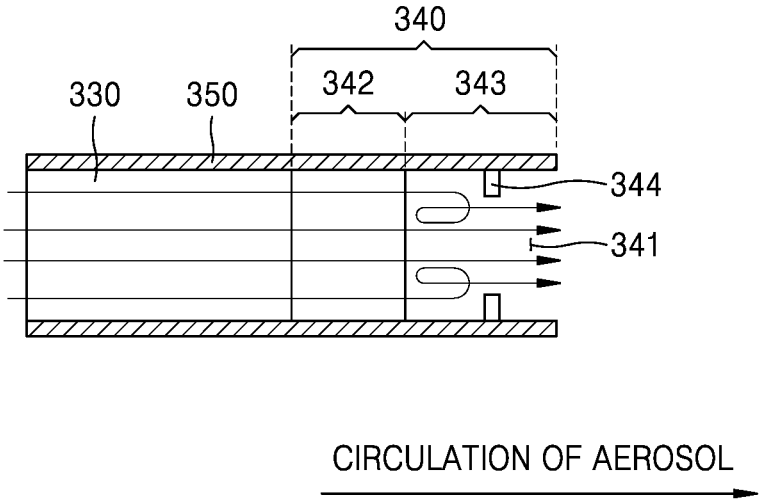
FIG. 9 is a view of a cooler and a filter of an aerosol generating article according to another embodiment.

FIG. 9 is a view of a cooler and a filter of an aerosol generating article according to another embodiment.

Referring to FIG. 9, the aerosol generating article according to another embodiment may include the cooler 330, the filter 340, a projector 344, and the wrapper 350. The aerosol generating article according to another embodiment may be the aerosol generating article of FIG. 6B, to which the projector 344 is added, and hereinafter, the same descriptions are omitted.

The projector 344 may project from an inner surface of the second filter portion 343 toward the cavity 341. For example, the projector 344 may project from the wrapper 350 defining the cavity 341 of the second filter portion 343 toward the cavity 341.

Aerosol having passed through the cooler 330 may pass through the first filter portion 342 and may reach the cavity 341. A circulation direction of the aerosol having reached the cavity 341 may be changed by the projector 344. As the circulation direction of the aerosol having reached the cavity 341 is changed by the projector 344, turbulence may be generated in the cavity 341. Therefore, the aerosol generating article may provide various absorption impressions to a user through the projector 344.

Figure 10:
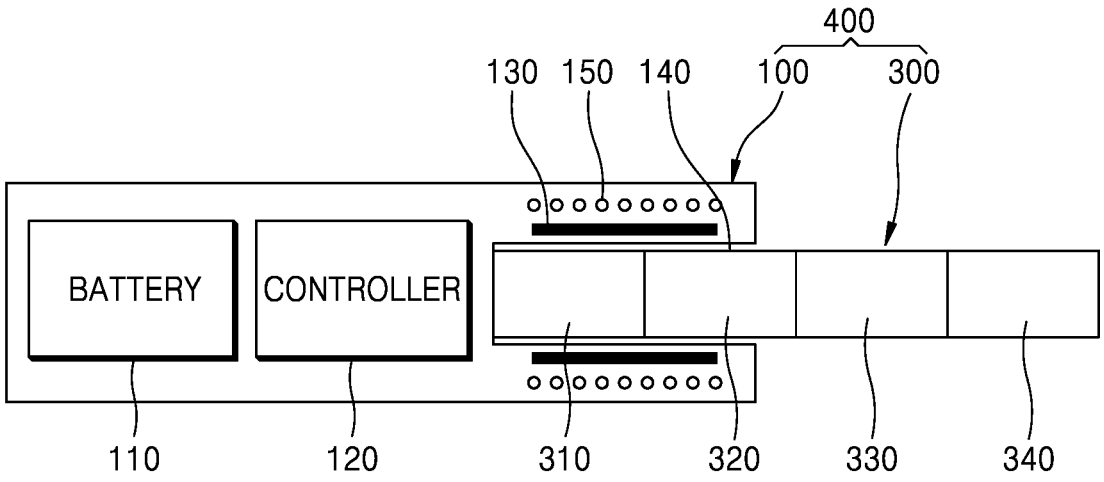
FIG. 10 is a view of an aerosol generating system according to another embodiment.

FIG. 10 is a view of an aerosol generating system according to another embodiment.

Referring to FIG. 10, an aerosol generating system 400 according to another embodiment may include the aerosol generating article 300 and the aerosol generating device 100 according to the embodiments described above.

The aerosol generating device 100 may include the battery 110, the controller 120, the heating element 130, an accommodation space 140, and an induction coil 150. The battery 110, the controller 120, and the heating element 130 may be substantially the same as the battery 110, the controller 120, and the heating element 130 of FIG. 1. Therefore, the same descriptions are omitted.

The accommodation space 140 may accommodate the aerosol generating article 300. After the aerosol generating article 300 is inserted into the accommodation space 140, the aerosol generating article 300 may be removed from the accommodation space 140 after being used.

The induction coil 150 may be an electrically conductive coil generating an alternating current magnetic field by using power supplied from the battery 110. The induction coil 150 may be arranged to surround at least a portion of the accommodation space 140 and may apply an alternating current magnetic field to the heating element 130.

The heating element 130 may include a susceptor heated by the alternating current magnetic field applied by the induction coil 150.

For example, the susceptor may include at least one selected from a ferrite, a ferromagnetic alloy, stainless steel, Al, and a combination thereof.

In addition, the susceptor may include at least one selected from ceramics, such as graphite, Mo, silicon carbide, Nb, a nickel alloy, a metal film, zirconia, etc., a transition metal, such as Ni, Co, etc., a metalloid, such as B or P, and a combination thereof. However, the susceptor is not limited to the example described above and may include any material which may be heated to a desired temperature when an alternating current magnetic field is applied thereto.

The heating element 130 may surround the first segment 310 and the second segment 320 when the aerosol generating article 300 is inserted into the accommodation space 140. When the alternating current magnetic field is applied to the heating element 130 by the induction coil 150, the heating element 130 may be heated to heat at least a portion of the first segment 310 or the second segment 320 of the aerosol generating article 300. Thus, aerosol may be generated from the first liquid composition of the first segment 310 and the second liquid composition of the second segment 320, and the generated aerosol may be transferred to a user after passing through the cooler 330 and the filter 340.

When an exhaustion speed of the first liquid composition impregnated in the first segment 310 or an exhaustion speed of the second liquid composition impregnated in the second segment 320 is excessively high, the aerosol generating system 400 may not provide aerosol having a constant amount of smoke or flavor to the user. Thus, in order to adjust the amount of aerosol generated by the first segment 310 and the second segment 320, the heating element 130 of the aerosol generating system 400 may heat only a portion of the aerosol generating article 300.

For example, a length of the heating element 130 may be less than a sum of a length of the first segment 310 and a length of the second segment 320. In this case, a portion of the first segment 310 or the second segment 320 may not be directly heated by the heating element 130. Therefore, in the first segment 310 or the second segment 320, the exhaustion speed of the first liquid composition or the second liquid composition may be adjusted.

As another example, in the accommodation space 140, the heating element 130 may be moved in a direction toward the first segment 310 or the second segment 320 with respect to a longitudinal direction of the aerosol generating article 300. Because the heating element 130 is moved, the portion of the first segment 310 or the second segment 320, the portion being heated by the heating element 130 as time passes, may be changed. Thus, in the first segment 310 or the second segment 320, the exhaustion speed of the first liquid composition or the second liquid composition may be adjusted.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

What is claimed is:

1. An aerosol generating article comprising:

a first segment impregnated with a first liquid composition;

a second segment impregnated with a second liquid composition that is different from the first liquid composition;

a cooler configured to cool aerosol by allowing the aerosol, generated from the first segment or the second segment, to pass through the cooler; and a filter configured to filter the aerosol by allowing the aerosol having passed through the cooler to pass through the filter, wherein at least a portion of the filter is recessed to thereby form a cavity in the filter, wherein a wound paper sheet is filled in each of the first segment and the second segment, and wherein a filling density of the sheet filled in the first segment is higher than the filling density of the sheet filled in the second segment.

2. The aerosol generating article of claim 1, wherein each of the first liquid composition and the second liquid composition includes a tobacco extract.

3. The aerosol generating article of claim 2, wherein the tobacco extract of the first liquid composition is nicotine salts, and wherein the tobacco extract of the second liquid composition is freebase nicotine.

4. The aerosol generating article of claim 1, wherein an amount of the first liquid composition impregnated in the first segment is less than an amount of the second liquid composition impregnated in the second segment.

5. The aerosol generating article of claim 1, wherein the filter includes a flavor material adding a flavor to the aerosol having passed through the cooler.

6. The aerosol generating article of claim 1, wherein the filter includes:

a first filter portion connected to the cooler and including cellulose acetate; and a second filter portion connected to the first filter portion, and wherein at least a portion of the second filter portion is recessed in a direction toward the cooler to thereby form the cavity in the second filter portion.

7. The aerosol generating article of claim 6, wherein the cavity extends in a longitudinal direction of the aerosol generating article, and a cross-sectional area of the cavity increases as the cavity extends in the longitudinal direction of the aerosol generating article.

8. The aerosol generating article of claim 6, wherein the second filter portion includes a projector projecting from an inner surface of the second filter portion toward the cavity and changing circulation of the aerosol in the cavity.

9. An aerosol generating system comprising:

the aerosol generating article of claim 1; and an aerosol generating device including an accommodation space configured to accommodate the aerosol generating article and a heating element configured to heat the aerosol generating article.

10. The aerosol generating system of claim 9, wherein the heating element is configured to surround the first segment and the second segment when the aerosol generating article is inserted into the aerosol generating device.

11. The aerosol generating system of claim 9, wherein a length of the heating element is less than a sum of a length of the first segment and a length of the second segment.

* * * * *